United States Patent [19]

Fukuoka

[11] 4,145,148

[45] Mar. 20, 1979

[54] BALL-POINT PEN FOR A LOW-VISCOSITY INK

[75] Inventor: Mitsuhiro Fukuoka, Osaka, Japan

[73] Assignee: Sakura Color Products Corporation, Osaka, Japan

[21] Appl. No.: 757,494

[22] Filed: Jan. 7, 1977

[30] Foreign Application Priority Data

Oct. 1, 1976 [JP] Japan ..... 51/133220[U]
Oct. 1, 1976 [JP] Japan ..... 51/133221[U]

[51] Int. Cl.[2] ..... B43K 7/00
[52] U.S. Cl. ..... 401/209
[58] Field of Search ..... 401/209, 208, 210, 217, 401/198, 199

[56] References Cited

U.S. PATENT DOCUMENTS 3,533,708 10/1970 Horie ..... 401/209
3,572,954 3/1971 Cheron ..... 401/209 X

FOREIGN PATENT DOCUMENTS 248282 7/1966 Fed. Rep. of Germany ..... 401/209
1509356 1/1968 France ..... 401/209

*Primary Examiner*—Stephen C. Pellegrino
*Attorney, Agent, or Firm*—Armstrong, Nikaido, Marmelstein & Kubovcik

[57] ABSTRACT

A low-viscosity ink ball-point pen has a tip press-fitted at its rear end into a forward end of a barrel member housing an ink source therein. A ball is rotatably held in a ball socket at the forward end of the tip and supplied with ink from the ink source through an ink-feeding capillary element extending from the ink source into an axial hole formed in the rear end portion of the tip and extending toward the ball socket. The ball socket and the hole are communicated by a reduced axial passage extending between the bottoms of the ball socket and the hole. The forward end portion of the ink-feeding capillary element cooperates with the bottom of the hole to define a substantially closed chamber of a substantial volume whereby a substantial quantity of ink can be accumulated therein for uninterrupted writing for a long period of time. In addition, the effective cross-sectional area of the capillary element, through which ink can flow toward the ball, is increased with resultant increase in the rate of ink supply through the capillary element to the ball.

3 Claims, 18 Drawing Figures

BALL-POINT PEN FOR A LOW-VISCOSITY INK

The present invention relates to a writing instrument and, more particularly, to a ball-point pen of the type that is particularly used with a low-viscosity ink. The term "low-viscosity ink" used herein will generally mean an ink which is formed either of a mixture of water, a hydrophilic solvent having a high boiling point, such as glycerine or ethylene glycol, and a dye, or of a mixture of a solvent having a low boiling point of from 120 to 180° C., such as xylene, and a dye.

British patent specification No. 1,139,038 discloses a ball-point pen for use with a water-soluble or aqueous ink which comprises a casing formed of a barrel member and housing therein an ink source formed of a mass or bundle of fibers. A tip is secured at its rear end to the forward end of the casing and has a ball socket at the forward end. The tip is provided with an axial hole formed in the rear end portion and communicated with the ball socket by a reduced passage extending between the bottoms of the hole and the ball socket. An axially elongated ink-feeding capillary element, which is formed of a bundle of resin-bonded fibers, extends from the ink source into the axial hole in the tip to feed the ink from the ink source through the axial hole and reduced passage into the ball socket and thus to a ball rotatably held therein.

The reduced axial passage includes axially inner and outer portions adjacent to the axial hole and the ball socket, respectively. The axially outer portion of the reduced passage has an extremely small diameter. The ink-feeding capillary element has a forward end portion of a cross-section which is gradually reduced toward the ball point at the writing tip.

It has heretofore been believed that the forward end portion of an ink-feeding capillary element extends toward and reaches close to a ball at the writing tip in order that ink may be smoothly fed by capillary effect from an ink source to the ball. The ball-point pen structure disclosed in the British patent specification is generally based on the prior art belief. Thus, in an embodiment of the ball-point pen disclosed in the British patent, the ink-feeding capillary element extends through the axial hole and through both of the inner and outer portions of the reduced passage into the ball socket. In another embodiment, the capillary element extends through the axial hole into the axially inner portion of the reduced passage and falls short of the axially outer portion of the reduced passage. The axially inner part of the reduced passage is of a diameter substantially equal to that of the ball. The axially outer portion of the reduced passage is of a diameter which is much smaller than that of the ball.

In the manufacture of ball-point pens of the described structure, it will be liable to occur that the reduced end portion of the ink-feeding capillary element is press-fitted into the axially inner or outer portion of the reduced passage. This increases the density of the reduced end portion of the capillary element and thus decreases the rate of flow of the ink therethrough with a resultant difficulty that the writing fades out during writing and grazing or scratching occurs.

It is an object of the present invention to provide an improved low-viscosity ink ball-point pen in which a substantial quantity of ink can be accumulated within a tip between the reduced passage and the forward end portion of an ink-feeding capillary element.

According to the present invention, there is provided a ball-point pen for a low-viscosity ink which comprises a casing, a tip secured at its rear end to the forward end of said casing and having a ball socket at the rearward end, a ball rotatably received in and held by said ball socket, an ink source in said casing, said tip being provided with an axial hole formed in the rearward end portion and communicated with said ball socket by a reduced axial passage extending between the bottoms of said socket and said hole, an axially elongated ink-feeding capillary element extending from said ink source into said axial hole in said tip to feed the ink from said ink source through said axial hole and passage into said ball socket and thus to said ball, characterized in that a substantially closed chamber is defined in said axial hole between said ink-feeding capillary element and the bottom of said axial hole.

By this feature of the present invention, a substantial quantity of ink can be accumulated in the closed chamber and thus smoothly supplied therefrom through the reduced passage into the ball socket and thus to the ball therein for uninterrupted writing for a long period of time. In addition, the effective cross-sectional area of the ink-feeding capillary element, through which ink can flow toward the ball, is increased with resultant increase in the rata of ink supply through the capillary element to the ball.

The ink-feeding capillary element may be formed of a bundle of fibers, a mass of a porous material such as sintered powdery plastic particles, or a tubular element having a fine capillary axial through-hole or passage formed therein. The fibers used to form the ink-feeding capillary element may preferably be of approximately 3 deniers. The powdery plastic particles to be sintered may preferably be of approximately 60 mesh. An ink-feeding capillary element formed of a bundle of fibers of 3 deniers or of a mass of a sintered powdery plastic particles of 60 mesh will provide a porosity (ratio of the total of pores or voids in the capillary element relative to the total volume of the element) of approximately 60% which is suitable for the flow of a low-viscosity ink through the capillary element toward the ball. In the case where the ink-feeding capillary element is formed of a tubular element, the capillary aixal through-hole in the element should be of such a cross-sectional shape as to facilitate or cause flow of a low-viscosity ink therethrough by capillary effect.

In the case where the ink-feeding capillary element having a porosity of 60% is formed of either a bundle of bonded fibers or a mass of sintered powdery plastic particles, the dimensional relationship between the diameter of the ball at the forward end of the tip and the effective cross-sectional area of the capillary element, through which the low-viscosity ink flows, may preferably be as follows:

| Ball Diameter | Capillary Element Effective Cross-section (represented by diameter) |
|---|---|
| 0.4 mm | 0.39 mm or more |
| 0.6 mm | 0.50 mm or more |
| 0.8 mm | 0.60 mm or more |
| 1.0 mm | 0.68 mm or more |
| 1.2 mm | 0.75 mm or more |

If the porosity of the capillary element is larger than 60%, the effective cross-sectional area of the capillary element may be smaller than the above figures and vice versa. If the capillary element is formed or thicher fibers or of particles of larger size with the porosity of the capillary element being unchanged, the efective cross-sectional area of the element may be smaller than the above figures and vice versa. If the capillary element has a large absolute diameter, the effective cross-sectional area of the element may be smaller than the above figures.

In the case where the ink-feeding capillary element is formed of a tubular element having a capillary through-hole formed therein, the relationship between the ball diameter and the cross-sectional area of the capillary through-hole may preferably be as follows:

| Ball Diameter | Through-hole Cross-sectional Area |
|---|---|
| 0.4 mm | 0.06 $mm^2$ or more |
| 0.6 mm | 0.07 $mm^2$ or more |
| 0.8 mm | 0.09 $mm^2$ or more |
| 1.0 mm | 0.10 $mm^2$ or more |
| 1.2 mm | 0.11 $mm^2$ or more |

The cross-sectional area of the capillary through-hole may vary with the cross-sectional shapes of the through-hole.

In an embodiment of the invention, the axial hole may include a generally cylindrical forward end portion adjacent to the bottom of the hole and having an inner diameter smaller than that of the rest of the hole to provide the same with an annular shoulder. The ink-feeding capillary element may have a substantially circular cross-section and have a forward end portion in engagement with the annular shoulder to cooperate with the bottom of the hole and the inner peripheral surface of the small diameter portion of the hole to define the closed chamber.

In another embodiment of the invention, the axial hole may have a forwardly tapered inner peripheral surface portion and the ink-feeding capillary element has a forward end portion in engagement with the tapered inner peripheral surface portion of the hole to cooperate therwith and with the bottom of the hole to define the closed chamber.

In further embodiments of the invention, one of the axial hole and the ink-feeding capillary element may have a substantially cylindrical surface which is engaged by an annular ridge extending radially from the other.

In a still further embodiment of the invention, a recess may be formed in the forward end face of the ink-feeding capillary element and the forward end face may be in abutment engagement with the bottom of the hole whereby the closed chamber is formed by the recess and the bottom of the hole.

The present invention will be described by way of example with reference to the accompanying drawings.

Figure 1:
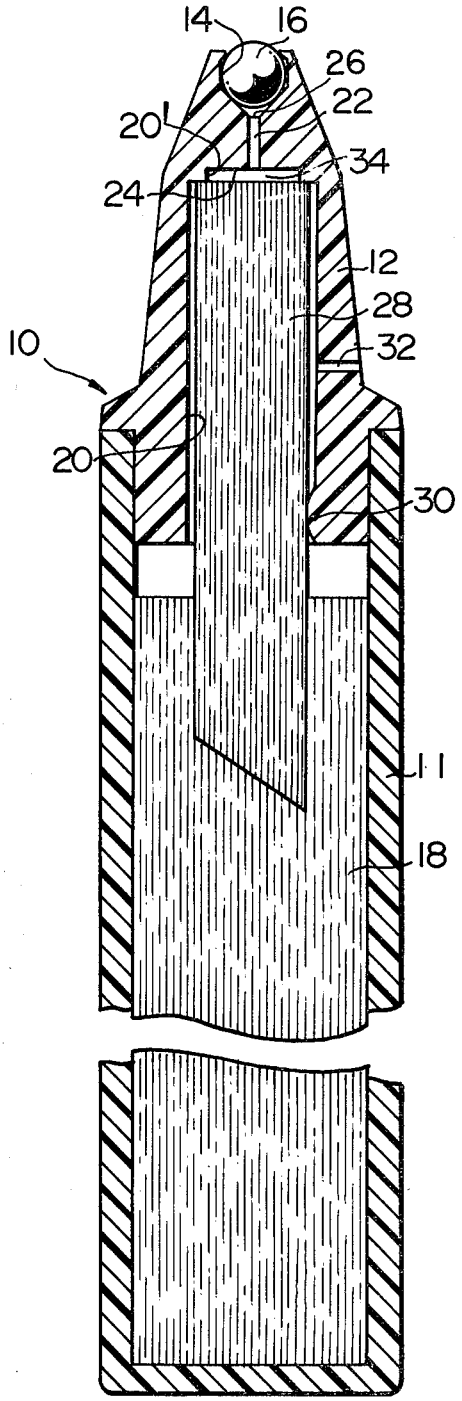
FIG. 1 is an axial sectional view of a first embodiment of the ball-point pen according to the present invention.
Figure 2:
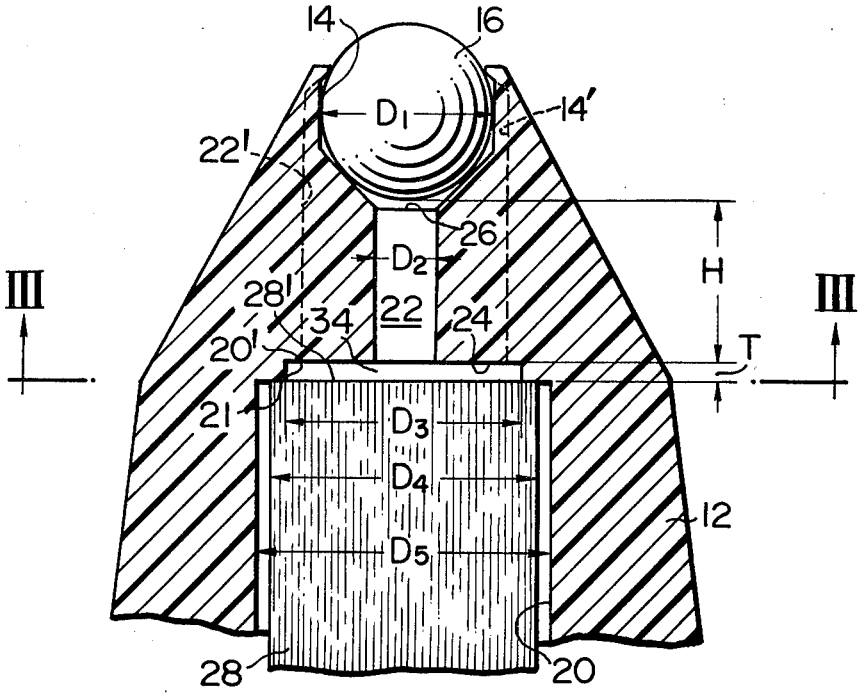
FIG. 2 is an enlarged fragmentary axial sectional view of the ball-point pen shown in FIG. 1 illustrating the details of the tip of the pen.
Figure 3:
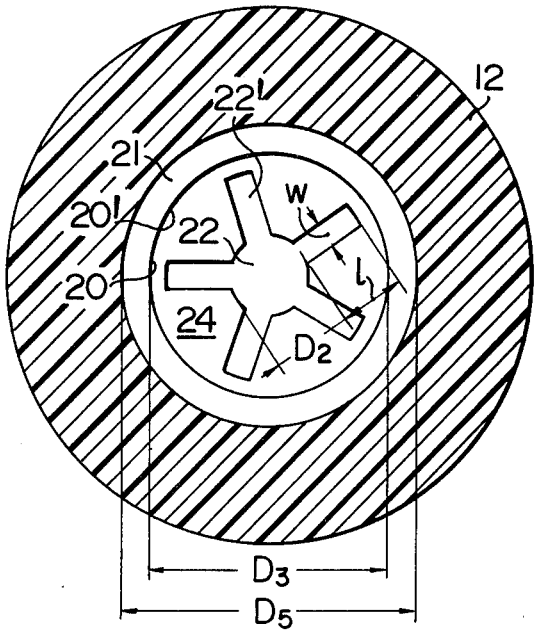
FIG. 3 is a cross-section taken on line III—III in FIG. 2.
Figure 4:
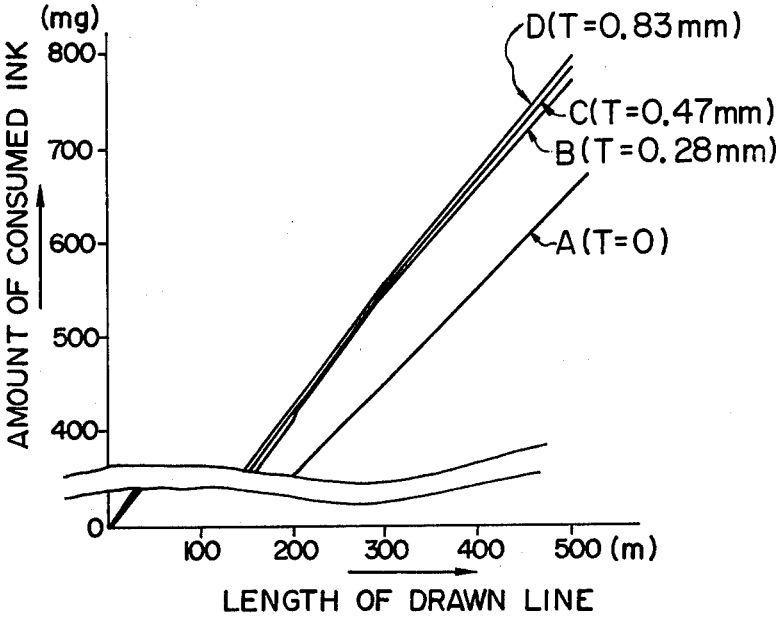
Figure 5:
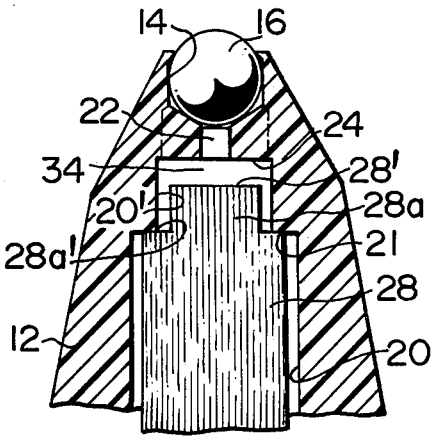
Figure 6:
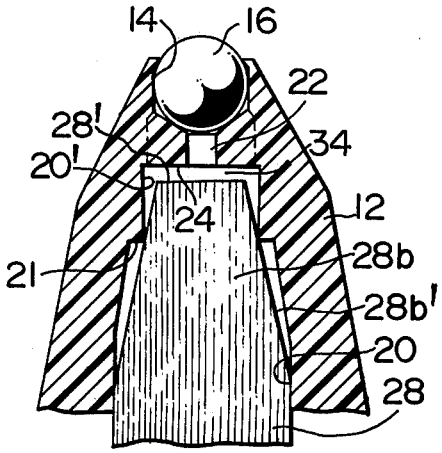
Figure 7:
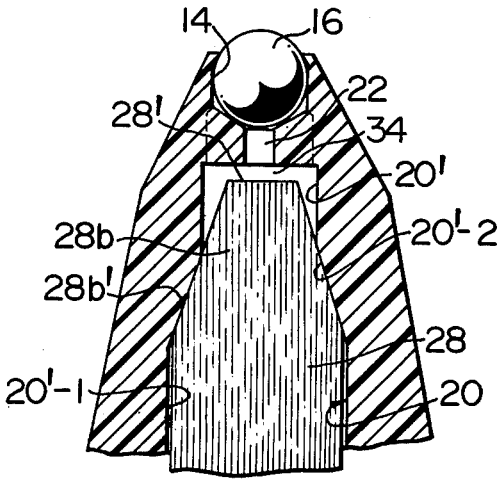
Figure 8A:
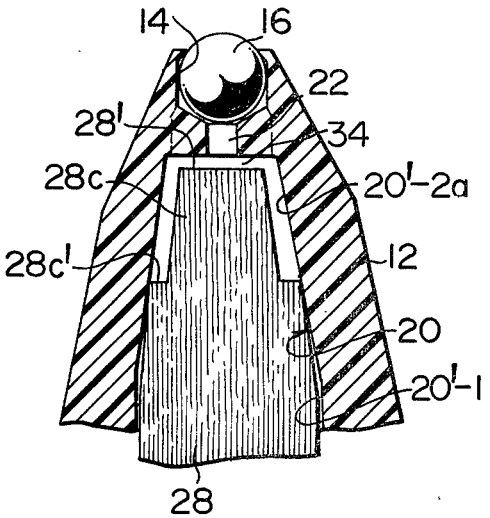
Figure 8B:
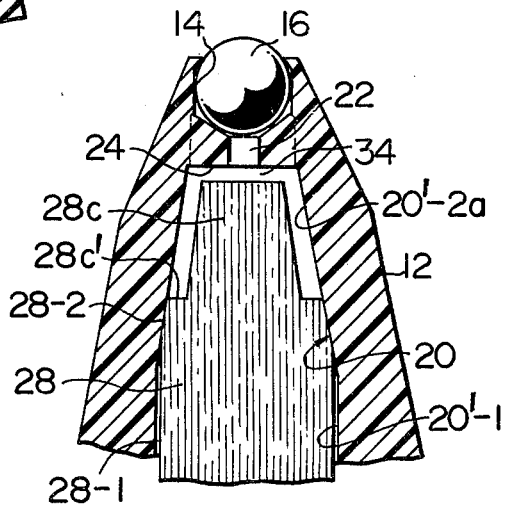
Figure 8C:
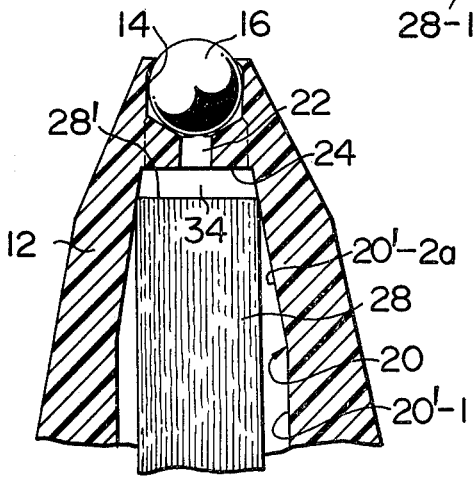
Figure 9A:
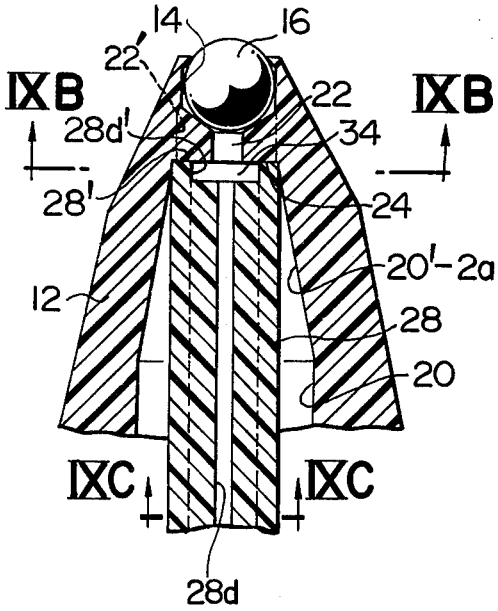
Figure 9B:
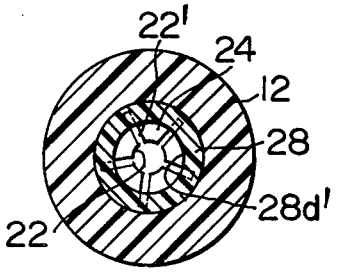
Figure 9C:
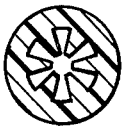
Figure 10A:
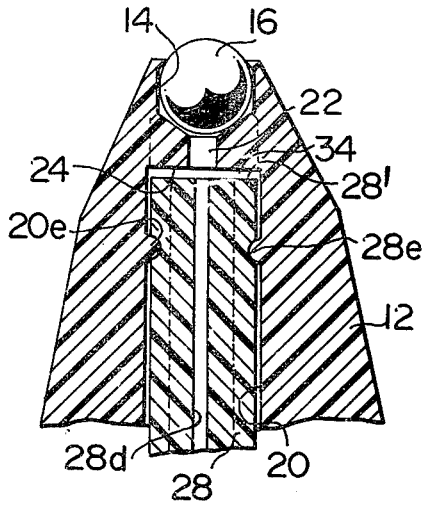
Figure 10B:
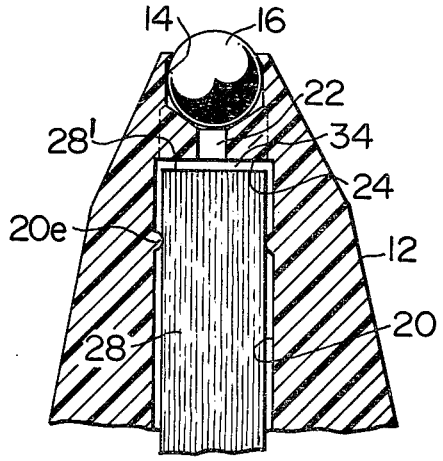
Figure 11A:
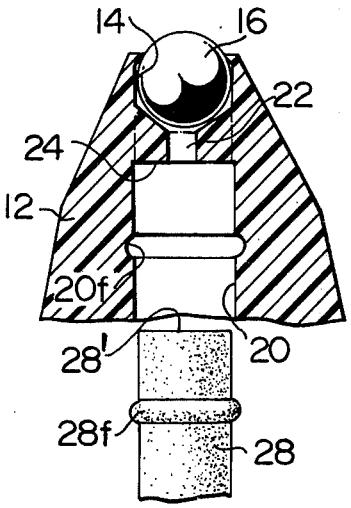
Figure 11B:
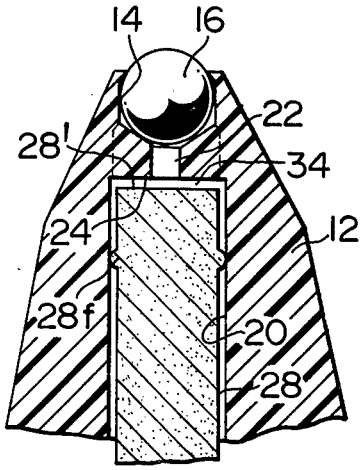
Figure 12:
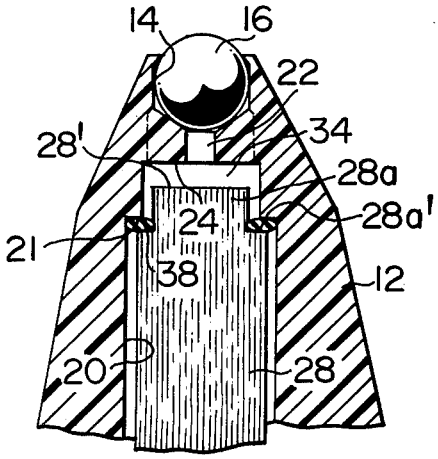

FIG. 4 graphically illustrates results of tests on ball-point pens according to the first embodiment of the invention and another ball-point pen concerning the lengths of lines drawn by the pens relative to the amounts of ink consumed;

FIG. 5 is a view similar to FIG. 2 but illustrating a first modification of the first embodiment;

FIG. 6 is a similar view illustrating a second modification of the first embodiment;

FIG. 7 is a similar view illustrating a second embodiment of the present invention;

FIG. 8A is a similar view illustrating a first modification of the second embodiment;

FIG. 8B is a similar view illustrating a second modification of the second embodiment;

FIG. 8C is a similar view illustrating a third modification of the second embodiment;

FIG. 9A is a similar view illustrating a third embodiment of the invention;

FIG. 9B is a cross-section taken on line IXB—IXB in FIG. 9A;

FIG. 9C is a cross-section taken on line IXC—IXC in FIG. 9A;

FIG. 10A is a view similar to FIG. 9A but illustrating a fourth embodiment of the invention;

FIG. 10B is a similar view illustrating a first modification of the fourth embodiment;

FIG. 11A illustrates in an enlarged section a second modification of the fourth embodiment;

FIG. 11B is a view similar to FIG. 10B but illustrating a third modification of the fourth embodiment; and FIG. 12 is a similar view illustrating a third modification of the first embodiment shown in FIGS. 1 to 3.

Similar parts are designated by similar reference numerals throughout the drawings.

Referring first to FIGS. 1 to 3, an embodiment of the low-viscosity ink ball-point pen according to the present invention is generally designated by 10 and comprises a casing formed of a barrel member 11 of a plastic material having a closed rearward end and an open forward end into which a tip generally designated by 12 is press-fitted at its rearward end. The tip 12 is provided with a ball socket 14 formed at the forward end of the tip and rotatably holding a ball 16 received in the socket 14. The barrel member 11 contains therein an ink source which is in the form of an adsorption reservoir structure formed of a bundle of fibers 18. The adsorption reservoir structure may alternatively be formed of another capillary member, such as a mass of rough felt (not shown) or a porous material (not shown). Further alternatively, the ink source may be in the form of an ordinary ink cartridge (not shown).

The tip 12 of a plastic material is provided with an axial hole 20 formed in the rearward end portion of the tip and communicated with the ball socket 14 by a reduced axial passage 22 extending between the bottom 24 of the axial hole 20 and the bottom 26 of the ball socket 14. An axially elongated ink-feeding capillary element 28 extends from the forward end of the ink source 18 into the axial hole 20 in the tip 12 to feed the ink from the ink source 18 through the hole 20 and the reduced passage 22 into the ball socket 14 and thus to the ball 16 therein. In the illustrated embodiment of the invention, the capillary element 28 has a substantially uniform diameter throughout the entire length thereof and is formed of a bundle of fibers of 3 denier bonded together by a thermosetting plastic material so that the bundle still possesses a capillary effect to cause the ink to flow therethrough.

The ink-feeding capillary element 28 is secured to the tip 12 by any conventional means. In the illustrated embodiment of the invention, the plastic tip 12 is welded at 30 to the capillary element 28 by moving a heated needle into contact with the outer peripheral surface of the tip 12 at the rearward end portion thereof. However, it will be apparent to those in the art that the capillary member 28 may alternatively be secured to the tip 12 either by an adhesive or by a pin extending through the wall of the tip 12 into the capillary member. Further alternatively, the capillary element 28 may be substantially snugly received into the hole 20 in the tip so that the hole supports the capillary member 28. An air vent 32 is formed in the tip 12.

The hole 20 is substantially cylindrical and has a forward end portion 20' which is adjacent to the bottom 24 of the hole and has a diameter smaller than that of the rest of the hole 20 to provide the same with an annular shoulder 21. The ink-feeding capillary element 28 has a substantially flat end face 28' which is in abutment engagement with the annular shoulder 21 to cooperate with the bottom 24 of the hole 20 and the inner peripheral surface of the small diameter portion 20' of the hole 20 to define a substantially closed chamber 34 to which the reduced passage 22 is open at the rearward end thereof.

As will be best seen in FIG. 3, the reduced passage 22 includes a plurality of grooves 22' formed in the tip 12 and extending radially outwardly from the passage 22 and between the bottoms 24 and 26 of the hole 20 and the ball socket 14. However, the grooves 22' are not essential for the ball-point pen according to the present invention as far as the ink flows through the passage 22 to the ball socket 14 at a rate substantially equal to or slightly larger than the rate at which the ink is consumed in writing, i.e., ink is applied to the surface of a sheet.

In the illustrated embodiment of the invention, the bottom 26 of the ball socket 14 is substantially frustoconical. However, the socket bottom 26 may alternatively be either flat or spherically concave. Grooves 14' are formed in the inner surface of the ball socket 14 to facilitate a smooth application of ink from the reduced passage 22 to the spherical surface of the ball 16.

As an example, respective parts of the ball-point pen shown in FIGS. 2 and 3 have following dimensions:

Diameter $D_1$ of ball 16: 0.60 mm
Diameter $D_2$ of reduced passage 22: 0.25 mm
Diameter $D_3$ of forward hole end portion 20': 0.90 mm
Diameter $D_4$ of capillary element 28: 1.15 mm
Diameter $D_5$ of axial hole 20: 1.20 mm
Axial distance H between ball 16 and chamber 34: 0.50 mm
Radial dimension of each groove 22': 0.20 mm
Width w of each groove 22': 0.10 mm
Axial dimension T of chamber 34: 0.28 to 0.83 mm In operation, the capillary effect of the ink-feeding capillary element 28 causes the ink to flow therethrough to the chamber 34. If the axial dimension T of the chamber 34 is so large that the ink does not flow through the chamber 34 into the reduced passage 22 solely by capillary effect, the ball-point pen 10 may be either kept upstanding with the writing tip down to cause the ink to flow downwardly by gravity or shaked to subject the ink to centrifugal force so that the ink is caused to flow toward the writing end of the pen. The ink then flows also by capillary effect from the chamber 34 through the reduced passage 22 into the socket 14 and thus to the ball 16.

In the prior art, it was believed that the provision of the space or chamber (34) between the forward end of an ink-feeding capillary element and a reduced passage just behind a ball socket would not be desirable for the smooth feed of ink to a ball. In other words, such a space as the chamber 34 according to the present invention was considered to adversely affect the capillary effect and interrupt and block the flow of ink from the ink-feeding capillary element to the reduced passage and the ball. In the prior art ball-point pen, therefore, the forward end face of the ink-feeding capillary element was in direct abutment engagement with the bottom of the hole in the tip. This arrangement of the prior art, however, has a difficulty as discussed previously.

Tests have shown that the provision of the substantially closed chamber 34 in the axial hole 20 between the ink-feeding capillary element 28 and the bottom 24 of the axial hole is satisfactory and facilitates a smooth supply of the ink from the capillary element 28 into the reduced passage 22 and thus to the ball 16 so that any grazing or scratching is avoided. The tests are concerned with the lengths of lines continuously and uninterruptedly drawn relative to the amounts of ink consumed. Line A in FIG. 4 shows the result of the test on a ball-point pen which was not provided with the closed chamber 34 (i.e., T = 0), whereas other lines B to D in FIG. 4 show results of tests on ball-point pens according to the illustrated embodiment of the invention which were provided with closed chambers 34 having axial dimensions T of 0.28 mm, 0.47 mm and 0.83 mm, respectively. All parts of the tested pens except axial dimension T were of the same dimensions. Lines were drawn by the ball-point pens. Lengths of lines and amounts of ink consumed by the drawing or writing were measured and plotted.

As will be seen in FIG. 4, the three ball-point pens according to the first embodiment of the invention shown in FIGS. 1 to 3 exhibited a substantially equal ink consumption, as illustrated by lines B to D, which is greater than that of the other tested ball-point pen, as illustrated by line A. This will mean that ink was more smoothly fed to the balls of the ball-point pens of the first embodiment of the invention than in the other tested ball-point pen. This difference is believed to have been caused by the provision according to the invention of the substantially closed chamber between the ink-feeding capillary element and the bottom of the axial hole in the tip.

As briefly discussed previously, the forward end portion of the ink-feeding capillary element of the prior art ball-point pen was reduced toward the ball and the reduced forward end portion was inserted into the reduced passage formed in the tip adjacent to the ball. The reduced passage included an axially inner passage portion adjacent to the hole in the rearward end portion of the tip and an axially outer passage portion disposed just behind the ball and having a cross-section much smaller than that of the axially inner passage portion. In the case where the reduced forward end portion of the ink-feeding capillary element extended through the axially inner passage portion into the axially outer passage portion, this portion of the capillary element provided an extensively reduced effective cross-section through which the ink could flow. In addition, the reduced forward end portion of the capillary element when inserted into the axially outer passage portion was liable to be press-fitted and thus radially inwardly pressed by the inner peripheral surface of the passage portion with resultant increase in the density of the filaments in the press-fitted part of the capillary element and thus decrease in the rate of flow of ink therethrough. In the case where the forward end portion of the capillary element extended into the axially inner passage portion of the reduced passage in the tip, but not into the axially outer passage portion of the reduced passage, the forward end face of the capillary element was liable to be pressed against the annular shoulder formed between the axially inner and outer passage portions. This was ascertained by removing ink-feeding capillary elements from the prior art ball-point pens. The forward end faces of some of the removed capillary elements were deformed by the pressure-contact with the annular shoulder between the axially inner and outer passage portions of the reduced passage in the tip. Apparently, the pressure-contact between the forward end of the capillary element and the annular shoulder will mean that the effective cross-section of the capillary element through which ink can flow is reduced and rendered equal to the cross-sectional area of the axially outer passage portion just behind the ball.

In any case, the reduced forward end portion of the ink-feeding capillary element of the prior art ball-point pen provided an extremely reduced and small effective cross-sectional area through which ink had to flow toward the ball. Thus, when writing is relatively fast or when the surface of a sheet to be written is of a relatively high ink-absorption characteristic, the rate at which the ink is consumed by writing is larger than the rate at which the ink flows through the reduced cross-sectional area of the forward end portion of the ink-feeding capillary element. Accordingly, when an amount of ink contained in the ball socket and in any space in the tip between the forward end of the capillary element and the ball socket has all been spent in a continuous and uninterrupted writing, the supply of ink through the reduced cross-sectional area of the forward end of the capillary element is insufficient to enable the writing to be continued, with the result that the ball lacks ink and thus grazing or scratching occurs.

To the contrary, the provision of the chamber 34 between the forward end portion of the ink-feeding capillary element 28 and the bottom 24 of the hole 20 assures that a larger amount of ink can be accumulated in the chamber 34 and also in the reduced passage 22 and the effective cross-sectional area (represented by the diameter $D_3$) of the forward end portion of the ink-feeding capillary element 28 through which the ink from the ink source 18 can flow toward the ball 16 is extensively increased, as compared with the prior art ball-point pen. Thus, when writing is commenced, the ball 16 is supplied with ink from the chamber 34 and the reduced passage 22. The ink supply from the chamber 34 will produce a partial vacuum therein which induces flow of ink from the ink source 18 through the ink-feeding capillary element 28 into the chamber 34. The increased effective cross-sectional area (diameter $D_3$) of the forward end portion of the ink-feeding element 28 assures an increased supply of ink from the ink source 18 into the chamber 34. The rate of ink supply to the chamber 34 can be balanced with the rate of ink consumption. This assures a smooth and uninterrupted writing at any increased writing speed and with any high ink-absorption characteristic of a sheet on which to be written. In addition, the abutment engagement between the forward end face of the ink-feeding capillary element 28 and the annular shoulder 21 of the axial hole 20 prevents air from entering the chamber 34 and thus assures a smooth writing which would be otherwise disturbed by air trapped in the ink. The air trapped in the ink would also cause grazing or scratching because supply of ink to the ball is interrupted by the trapped air.

The axial dimension T of up to 0.83 mm disclosed previously is not the maximum limit. The inventor has ascertained through tests that the supply of ink through the chamber 34 toward the ball 16 has not been interrupted even when the dimension T has been increased up to 10 mm. However, the range of this dimension shown previously is preferred.

FIG. 5 illustrates a first modification of the first embodiment discussed above. In the modification, the ink-feeding capillary element 28 has a forward end portion **28*a* of a diameter smaller than that of the rest of the element 28 to provide the same with a forwardly directed second annular shoulder 28*a*'. The small-diameter forward end portion has a forward end face 28' and extends into the small-diameter forward end portion 20' of the hole 20 with the two annular shoulders 21 and 28*a*' being in abutment engagement with each other. A substantially closed chamber 34 is also defined in this modification between the forward end face 28' of the ink-feeding element 28 and the bottom 24 of the axial hole 20. The axial dimension of the small-diameter forward end portion 20' of the hole 20 is less than that of the forward end portion 20' of the hole 20 formed in the tip 12 of the embodiment shown in FIGS. 1 to 3**.

FIG. 6 illustrates a second modification of the first embodiment. In this modification, the tip 12 is of a structure substantially similar to that of the tip 12 of the first modification shown in FIG. 5. The ink-feeding capillary element 28 is of a slightly modified structure and has a forward end portion **28*b* which has a forwardly tapered peripheral surface 28*b*'. The forward end portion 28*b* of the capillary element 28 partially extends into the small-diameter forward end portion 20' of the hole 20 with the forward end face 28' being spaced from the bottom 24 of the hole and with the tapered surface 28*b*' of the capillary element 28 being in engagement with the inner peripheral edge of the annular shoulder 21 on the inner periphery of the hole 20. The forward end face 28' of the capillary element 28 and the portion of the forwardly tapered peripheral surface 28*b*' thereof forwardly of the annular edge 21 cooperate with the inner peripheral surface of the small-diameter portion 20' of the hole 20 and the bottom 24 thereof to define a substantially closed chamber 34**.

FIG. 7 illustrates a second embodiment of the invention. In this embodiment, the inner peripheral surface of the hole 20 formed in the tip 12 includes a cylindrical forward end portion 20' adjacent to the bottom or transitional face 24 of the hole and a cylindrical rearward portion 20'-1 axially spaced from the forward end portion 20' and connected thereto by a forwardly tapered intermediate portion 20'-2. The ink-feeding capillary element 28 of the embodiment has a structure substantially similar to that of the second modification of the first embodiment shown in FIG. 6 and partially extends into the forward end portion 20' of the hole with forward end face 28' of the capillary element 28 being spaced from the bottom 24 of the hole 20 and with the forwardly tapered peripheral surface **28*b* of the capillary element 28 being in face-to-face engagement with the forwardly tapered intermediate portion 20'-2 of the inner peripheral surface of the hole 20**. The forward end face 28' of the capillary element 28 and the portion of the forwardly tapered peripheral surface 28*b* thereof forwardly of the forwardly tapered intermediate portion 20'-2 of the hole 20 cooperate with the bottom 24 of the hole 20 and the forward portion 20' thereof to define a substantially closed chamber 34.

FIGS. 8A to 8C illustrate first to third modifications of the second embodiment shown in FIG. 7. In FIG. 8A, the hole 20 formed in the tip 12 includes a substantially cylindrical rearward end portion 20'-1 and a forward end portion 20'-2*a* which is forwardly tapered from the rearward end portion 20'-1 to the bottom 24 of the hole 20. The ink-feeding capillary element 28 has a forward end portion 28*c* of a diameter smaller than that of the rest of the capillary element 28 to provide the same with a forwardly directed annular shoulder 28*c*'. The forward end portion 28C of the capillary element extends into the forwardly tapered end portion 20'-2a of the hole 20 with the forward end face 28' of the capillary element 28 being spaced from the bottom 24 of the hole 20 and with the outer peripheral edge of the annular shoulder 28C' being in engagement with the inner peripheral surface of the forwardly tapered end portion 20'-2*a* of the hole 20 so that a substantially closed, generally cup-shaped chamber 34 is defined by the cooperation of the forward end face 28', the peripheral surface of the forward end portion 28C and the annular shoulder 28C' of the capillary element 28 and the bottom 24 and the inner peripheral surface of the tapered forward end portion 20'-2*a* of the hole 20.

In the second modification shown in FIG. 8B, the tip 12 is substantially similar in structure to the tip 12 shown in FIG. 8A. However, the ink-feeding capillary element 28 is of a slightly modified structure. The modification is that the capillary element 28 includes an intermediate portion 28-2 which is forwardly tapered from a substantially cylindrical rearward end portion 28-1 to the outer peripheral edge of the annular shoulder 28C' of the forward end portion 28C. The tapered intermediate portion 28-2 of the capillary element 28 is in face-to-face engagement with the forwardly tapered inner surface of the forward end portion 20'-2*a* of the hole 20. The chamber 34 provided by the modification is generally cup-shaped as in the first modification shown in FIG. 8A.

In the third modification shown in FIG. 8C, the tip 12 is similar in structure to the first and second modifications shown in FIGS. 8A and 8B. However, the ink-feeding capillary element 28 is modified and is substantially cylindrical throughout the entire length thereof. The forward end face 28' of the capillary element is substantially flat and has a circular peripheral edge which is engaged with the forwardly tapered inner peripheral surface of the forward end portion 20'-2*a* of the hole 20 in the tip 12. Thus, the forward end face 28' of the capillary element 28 and the bottom 24 of the hole 20 cooperate with the portion of the forwardly tapered inner peripheral surface 20'-2*a* of the hole 20 to define the chamber 34.

FIGS. 9A and 9B illustrate a third embodiment of the invention. The embodiment comprises a tip 12 of a structure similar to those of the tips 12 shown in FIGS. 8A to 8C. The ink-feeding capillary element 28 of this embodiment, however, is formed of a tube of a plastic material defining therein an axial capillary passage 28*d* of a cross-section shown in FIG. 9C. The tube 28 extends through the hole 20 in the tip 12 and has a forward end face 28' in abutment engagement with the bottom 24 of the hole 20. A recess 28*d*' is formed in the forward end face 28' of the tube 28 coaxially with the capillary passage 28*d* and cooperates with the bottom 24 of the hole 20 to define a substantially closed chamber 34.

FIG. 10A illustrates a fourth embodiment of the invention, in which the hole 20 formed in the tip 12 is of a diameter which is substantially uniform throughout the entire length of the hole 20 with the exception that an annular ridge 20*e* is formed on and radially inwardly extends from the inner peripheral surface of the hole 20 at a place relatively near to the bottom 24 of the hole. The ink-feeding capillary element 28 is formed of a tube of a plastic material defining therein an axial capillary passage 28*d* as in the third embodiment shown in FIGS. 9A and 9B. The tube 28 has its forward end face 28' spaced a distance from the bottom 24 of the hole 20 to cooperate therewith to define the chamber 34. The outer peripheral surface of the tube 28 is formed therein with an annular groove 28*e* which is in engagement with the inner peripheral edge portion of the annular ridge 20*e* on the inner peripheral surface of the hole 20 to provide an air-tight seal between the inner and outer peripheral surfaces of the hole 20 and the tube 28. The annular groove 28*e* may be conveniently machined by a cutter.

FIGS. 10B to 11B illustrate first to third modifications of the fourth embodiment shown in FIG. 10A. In the first modification shown in FIG. 10B, the tip 12 is of a structure similar to that of the tip 12 shown in FIG. 10A and has an annular ridge 20*e* radially inwardly extending from the inner peripheral surface of the hole 20. The ink-feeding capillary element 28 is formed of a bundle of fibers and has a flat forward end face 28' spaced a distance from the bottom 24 of the hole 20 to cooperate therewith to define the chamber 34. The capillary element 28 has a substantially cylindrical peripheral surface with which the inner peripheral edge of the annular ridge 20*e* is engaged to provide an annular air-tight seal between the inner and outer peripheral surfaces of the hole 20 and the capillary element 28.

In the second modification shown in FIG. 11A, the hole 20 formed in the tip 12 has a substantially cylindrical inner surface and is formed therein with an annular groove 20*f*. The ink-feeding capillary element 28 is formed of an axially elongated mass of a sintered powdery plastic particles of about 60 mesh. The element 28 has an annular ridge 28*f* extending radially outwardly from the peripheral surface thereof. The tip 12 and the capillary element 28 are shown in their disassembled position. It will be noted that the forward end portion of the capillary element 28 may be inserted into the hole 20 in the tip so that the annular ridge 28*f* is snupped into the annular groove 20*f*. The portion of the capillary element 28 forward of the annular ridge 20*f* is dimensioned such that, when the element 28 is inserted into the hole 20 until the annular ridge 28*f* is snupped into the annular groove 28*f*, the forward end face 28' is spaced a distance from the bottom 24 of the hole 20 to cooperate therewith to define a substantially closed chamber (not shown in FIG. 11A) as in the first modification shown in FIG. 10B.

In the third modification shown in FIG. 11B, the hole 20 in the tip 12 has a substantially cylindrical inner peripheral surface, whereas the ink-feeding capillary element 28, which is made of a sintered plastic powder as in the second modification shown in FIG. 11A, has an annular ridge radially outwradly extending from the peripheral surface of the capillary element 28 into engagement with the cylindrical inner peripheral surface of the hole 20 to provide an air-tight seal therebetween.

Finally, FIG. 12 illustrates a third modification of the first embodiment shown in FIGS. 1 to 3. In the modification, the tip 12 and the ink-feeding capillary element 28 are similar in structure to those of the first modification of the first embodiment shown in FIG. 5. Only difference between the third and first modifications of the first embodiment is that a packing ring 38 is interposed between the two forwardly and rearwardly directed annular shoulders 28*a*′ and 21 of the capillary element 28 and hole 20, respectively, to positively seal the chamber 34 from the annular space between the inner and outer peripheral surfaces of the hole 20 and the capillary element 28.

What is claimed is:

1. A ball-point pen for use with a low-viscosity ink comprising:

a casing having forward and rearward ends;

a tip having forward and rearward ends, said tip being secured at said rearward end to said forward end of said casing;

a ball socket positioned at said forward end of said tip;

a ball rotatably received in said ball socket;

a reduced diameter axially extending passage formed in said tip having forward and rearward ends, said reduced diameter passage forward end communicating with said ball socket;

an axially extending capillary element passage formed in said tip having forward and rearward ends, said forward end of said capillary element passage communicating with said rearward end of said reduced diameter passage;

a chamber portion having a cross-sectional area intermediate that of said reduced-diameter passage and said capillary element passage and having forward and rearward ends, said chamber portion being positioned between said rearward end of said reduced-diameter passage and said forward end of said capillary element passage, said chamber portion including a flat-faced shoulder at said rearward end and a transitional face at said forward end;

an ink source in said casing;

an axially elongated ink-feeding capillary element extending from said ink source into said axially extending capillary element passage in said tip, said capillary element including a flat face at a forward end, said flat face being positioned in abuting engagement with the flat face of said shoulder; wherein a substantially closed chamber is defined, bounded by the intermediate cross-sectional area portion, the flat forward face of said ink feeding capillary element and said transitional face.

2. A ball-point pen according to claim 1, wherein said forward end portion of said ink-feeding capillary element has a cross-sectional area smaller than that of the rest of said capillary element to provide the same with a forwardly directed flat shoulder which is in abutting engagement with said flat-faced shoulder.

3. A ball-point pen according to claim 1, wherein said ink-feeding capillary element further comprises a forward end portion of a cross-sectional area smaller than that of the rest of both said capillary element and of said intermediate cross-sectional area portion to provide said capillary element with a shoulder, said forward end portion of said capillary element extending into said intermediate cross-sectional area portion and having a forward end face spaced from the transitional face, a packing being interposed between said capillary shoulder and said intermediate cross-sectional area portion shoulder.

* * * * *